US008875417B2

(12) United States Patent
Alberi

(10) Patent No.: US 8,875,417 B2
(45) Date of Patent: Nov. 4, 2014

(54) SANDAL

(76) Inventor: Eileen Alberi, New York, NY (US)

( * ) Notice: Subject to any disclaimer, the term of this patent is extended or adjusted under 35 U.S.C. 154(b) by 748 days.

(21) Appl. No.: 12/895,160

(22) Filed: Sep. 30, 2010

(65) Prior Publication Data

US 2012/0079738 A1 Apr. 5, 2012

(51) Int. Cl.

| | |
|---|---|
| ***A43B 3/12*** | (2006.01) |
| ***A43B 3/18*** | (2006.01) |
| ***A43C 11/00*** | (2006.01) |
| ***A43B 3/24*** | (2006.01) |
| ***A43B 23/00*** | (2006.01) |
| ***A43B 13/00*** | (2006.01) |

(52) U.S. Cl.

CPC ..... *A43B 3/122* (2013.01); *A43B 3/244* (2013.01)

USPC ..... 36/11.5; 36/7.7; 36/7.5; 36/50.1; 36/100; 36/136; 36/101; 36/103

(58) Field of Classification Search

CPC ..... A43B 3/103; A43B 3/105; A43B 3/12; A43B 3/122; A43B 3/126

USPC ..... 36/11.5, 7.7, 7.5, 7.6, 135, 62, 100, 36/101, 136, 50.1, 103

See application file for complete search history.

(56) References Cited

U.S. PATENT DOCUMENTS

| | | | | | |
|---|---|---|---|---|---|
| D35,490 | S | | 12/1901 | Hatheway | |
| 1,784,035 | A | * | 12/1930 | Von Wilmowsky | 36/11.5 |
| 2,173,702 | A | * | 9/1939 | Winkel | 36/11.5 |
| 2,352,098 | A | | 6/1944 | Hess | |
| 2,367,092 | A | * | 1/1945 | Blotner | 36/11.5 |
| 2,395,767 | A | * | 2/1946 | Sutcliffe | 36/11.5 |
| 2,551,723 | A | * | 5/1951 | Camero | 36/11.5 |
| 2,680,309 | A | | 6/1954 | Peterson | |
| 2,862,311 | A | | 12/1958 | Ellis | |
| 3,800,444 | A | * | 4/1974 | Young | 36/11.5 |
| D260,047 | S | | 8/1981 | Heinz | |
| 4,530,171 | A | * | 7/1985 | Zabala | 36/11.5 |
| 4,896,439 | A | * | 1/1990 | Morgan | 36/7.5 |
| 6,516,538 | B2 | | 2/2003 | Kraft | |
| 7,347,010 | B2 | * | 3/2008 | Yu | 36/11.5 |
| 2002/0100189 | A1 | * | 8/2002 | Manzi | 36/100 |
| 2005/0257399 | A1 | * | 11/2005 | Yu | 36/11.5 |
| 2006/0026861 | A1 | * | 2/2006 | Manzi | 36/11.5 |
| 2009/0133289 | A1 | * | 5/2009 | Cantoni | 36/101 |
| 2009/0193684 | A1 | * | 8/2009 | Diamond | 36/101 |

FOREIGN PATENT DOCUMENTS

| | | |
|---|---|---|
| GB | 471135 | 8/1937 |

* cited by examiner

*Primary Examiner* — Clinton T Ostrup
*Assistant Examiner* — Cameron A Carter
(74) *Attorney, Agent, or Firm* — Marvin Petry; Stites & Harbision PLLC

(57) ABSTRACT

A sandal that includes loops extending around the periphery of the base of the sandal and a strap configured to connect to the loops and form an upper portion of the sandal. The sandals can include a base; a continuous cord that extends along the periphery of the upper surface of the base from a point near the toe end on one side of the base, around the heel end, and continues to a point near the toe end on the opposite side of the base; connectors that connect the cord to the base at spaced locations along the cord to thereby form loops along the base; and a strap. Each loop of the sandal can also include an identifier for each loop. Methods of forming an upper portion of a sandal and methods of forming a sandal.

8 Claims, 5 Drawing Sheets

SANDAL

FIELD OF THE INVENTION

The present invention relates to a sandal and, more particularly, to a sandal that makes use of loops on the base of the sandal which allow the strap of the sandal to be placed in different configurations and provide a wearer with the ability to change the appearance of the upper portion of the sandal without changing the base of the sandal.

BACKGROUND OF THE INVENTION

Sandals of varying shapes and styles are routinely worn by individuals as they are not only regarded as a light, open, and comfortable form of footwear, but they are also frequently regarded as a stylish form of footwear. Indeed, it is not uncommon for one individual to own multiple pairs of sandals of varying colors and styles such that the individual can readily select a pair of sandals that will be suitable for a particular outfit or occasion.

The majority of sandals that are currently available are comprised of a one piece base with an attached strap that engages the foot of a wearer in various locations to thereby secure the sandal on the wearer's foot. However, these sandals are routinely manufactured with the straps in fixed locations along the base of the sandal, thus making it impossible to place the straps in alternative positions, and also making it impossible to replace the strap such that it can be exchanged and matched to a particular outfit or occasion. In this regard, alternative designs for sandals have produced sandals where the straps may be removed and exchanged as desired. However, these alternative designs have produced sandals where the straps are still secured to only a few locations on the sandals and, consequently, individuals must still purchase multiple pairs of sandals in order to have multiple styles of sandals. Accordingly, a sandal having a strap that could be easily exchanged without changing the base of the sandal and that could be positioned at various locations along a single base would be highly desirable as such a sandal would provide an individual with the ability to construct a number of alternative sandal styles without having to purchase multiple pairs of sandals.

SUMMARY OF THE INVENTION

The present invention relates to a sandal that provides a wearer with the ability to change the appearance of the upper portion of the sandal without changing the base of the sandal.

In one exemplary embodiment, a sandal is provided that comprises a base having an upper surface and a lower surface, where the base extends from a rear heel end to a forward toe end of the sandal. A continuous cord extends along the periphery of the upper surface of the base from a point near the toe end on one side of the base, around the heel end, and continues to a point near the toe end on the opposite side of the base. The cord is connected to the base by connectors that are placed at spaced locations along the cord such that the cord portions between the connectors form loops around the periphery of the base. By forming the loops around the periphery of the base, a strap that is configured to connect (e.g., threaded through) to the loops can then be provided to thereby form the upper portion of the sandal.

In some embodiments, a sandal is provided that includes one or more segments of cord that are positioned in an interior portion of the base and extend in a direction that is transverse to the longitudinal direction of the base. Similar to the continuous cord described above, each of these segments of cord are connected to the base by connectors such that the one or more segments of cord form loops in the interior portion of the base. In certain embodiments, a segment of cord is positioned in the toe end of the base such that a thong loop is formed in the toe end of the base. In some embodiments, one or more segments of cord are positioned in an instep portion of the base such that one or more instep loops are formed in the instep portion of the base and are spaced at a predetermined distance from each adjacent instep loop.

The straps of the sandal can be provided in various forms such that a number of different upper portions of a sandal can be formed. In some embodiments, the strap is a continuous lace or other string that has opposed ends and is adapted to be easily threaded through the loops of the sandal. In other embodiments, the strap includes an attachment means such that the strap can be readily secured around a particular loop of the sandal. In still other embodiments, multiple styles of upper portions of a sandal can be formed by further providing a means for securing portions of the strap together, such as a clasp or buckle.

Further provided, in some embodiments of the present invention, is a sandal that comprises a base with a cord extending along at least a portion of the periphery of the sides of the upper surface of the base. Again, connectors connect the cord to the base at spaced locations along the cord such that the cord portions between the connectors form loops. However, in these embodiments, each loop further includes an identification means for identifying each loop of the sandal. In certain embodiments, the identification means for each loop along one side of the base corresponds to the identification means for each loop along the opposite side of the base such that a wearer can not only identify corresponding loops on each side of the base when connecting a strap to the base, but can also connect the strap to specific loops on the base to thereby produce an upper portion of the sandal with a particular configuration. In some embodiments, the loop at the rear heel end of the base includes a separate identification means as compared to each loop along the sides of the base. Further, in some embodiments, one or more segments of cord are positioned in and connected to an interior portion of the base to thereby form loops in the interior portion of the base, such as a thong loop or instep loop, that also include separate identification means.

Still further provided, in some embodiments of the present invention is a method of forming an upper portion of a sandal that includes: providing a base having a plurality of loops extending around at least a portion of a periphery of an upper surface of the base; threading a strap through the loops such that the strap is capable of being wrapped around the foot and/or ankle of a wearer; and securing the strap to the foot and/or ankle of a wearer to thereby form the upper portion of the sandal. In some embodiments of the methods, the base of the sandal further includes one or more loops in the interior portion of the base such that the strap can also be threaded through the one or more loops in the interior portion of the base and then secured to the foot and/or ankle of the wearer to thereby form the upper portion of the sandal.

A method of forming a sandal is also provided, in some embodiments, that includes providing a base in accordance with the present invention and attaching a preformed strap to the loops of base, where the preformed strap includes an attachment means for securing the preformed strap to at least one loop of the base.

Advantageously, the present invention thus provides a sandal, as well as a method of forming an upper portion of a sandal or a sandal itself, that allows for various straps to be connected to and removed from loops on the base of a sandal in order to produce a number of desired styles for an upper portion of a sandal. By forming a number of loops along the base of the sandal, the straps can be positioned at various locations along a single sandal base to thereby provide a sandal that can readily be adapted for a particular article of clothing or occasion.

DESCRIPTION OF EXEMPLARY EMBODIMENTS

The present invention relates to a sandal that includes loops on the base of the sandal which allow the strap of the sandal to be placed in different configurations and provide a wearer with the ability to change the appearance of the upper portion of the sandal without changing the base of the sandal.

Figure 1:
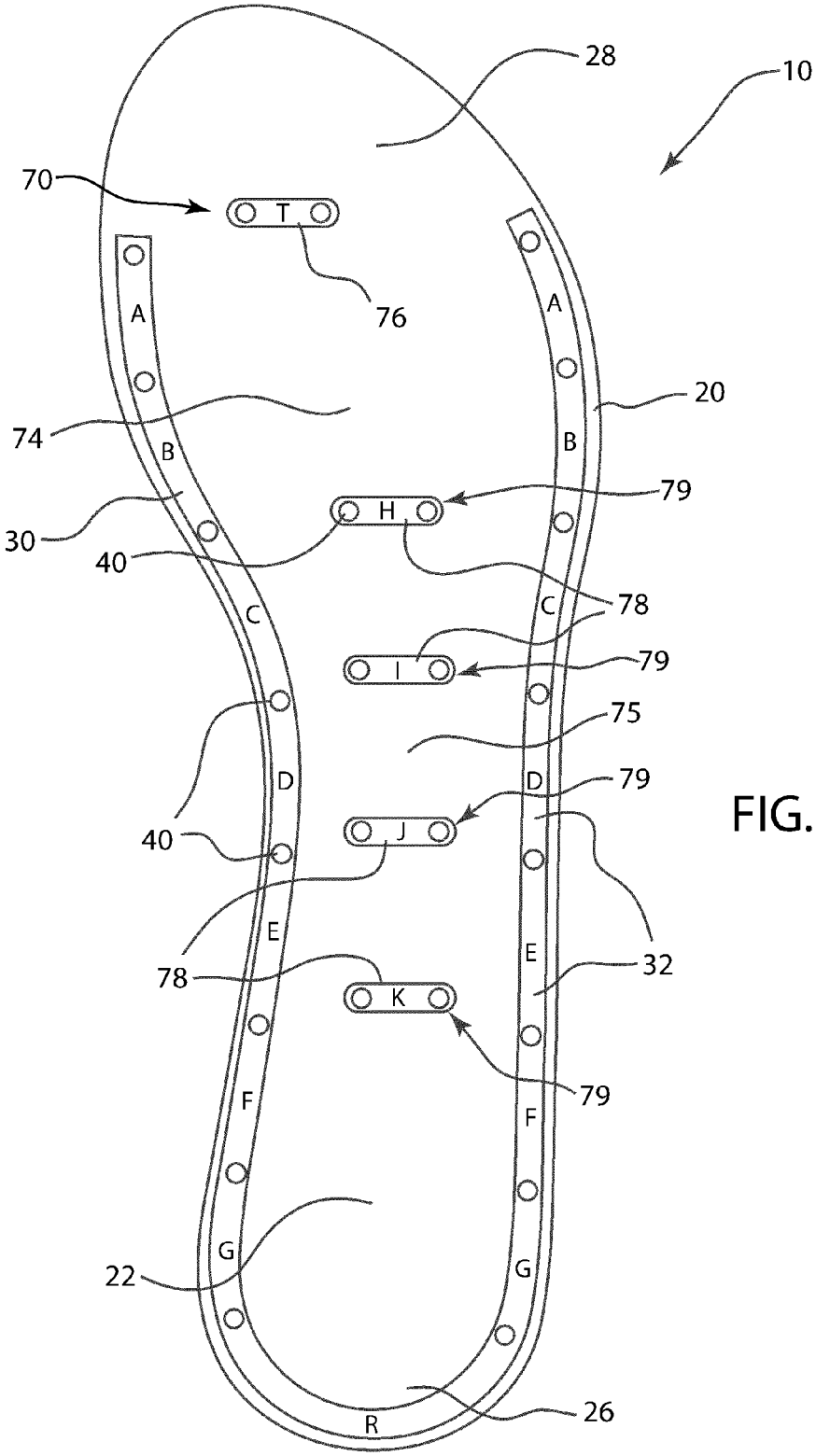
FIG. 1 is a top view of a sandal made in accordance with the present invention, but without a strap connected to the loops of the sandal.
Figure 2:
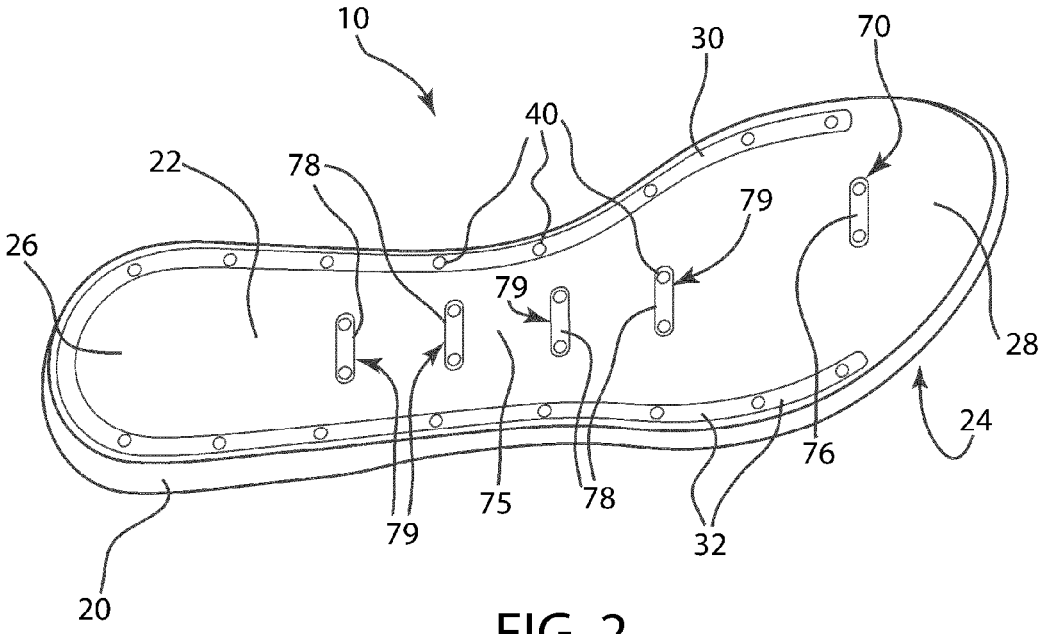
FIG. 2 is a perspective view of the exemplary sandal depicted in FIG. 1.

Referring first to FIGS. 1 and 2, in one exemplary embodiment of a sandal 10 made in accordance with the present invention, the sandal 10 includes a base 20 having an upper surface 22 and a lower surface 24, where the base 20 extends from a rear heel end 26 to a forward toe end 28. The base 20 can be comprised of a single durable layer of material, such as leather, rubber or the like, or can be formed of multiple layers of material to provide a harder or more durable layer that contacts the ground and a softer layer that contacts the foot of a wearer.

Regardless of the material used to produce the base 20, however, the sandal 10 further includes a cord 30 that extends along at least a portion of the periphery of the sides of the upper surface 22 of the base 20. In some embodiments, and as shown in FIGS. 1 and 2, the cord is a continuous cord 30 that extends along the periphery of the upper surface 22 of the base 20 from a point near the toe end 28 on one side of the base, around the heel end 26, and continues to a point near the toe end 28 on the opposite side of the base 20. The cord 30 is typically formed from a durable material, such as leather, plastic, or the like, such that the cord 30 is not easily broken when it is formed into loops, and used to secure a strap to the base 20 of the sandal 10, as described in further detail below. FIGS. 1 and 2 show loops 32 formed with continuous cord 30. Also shown therein is loop 76 formed with cord segment 70 and loops 78 formed with cord segments 79.

The cord 30 is connected to (i.e., secured to) the base 20 of the sandal 10 by one or more connectors 40. As would be recognized by those skilled in the art, the connectors 40 can be a variety of different means that are capable of securing the cord 30 to the base 20. For example, in some embodiments, the connectors 40 used to secure the cord 30 to the base 20 can be stitches, rivets, nailheads, or suitable adhesives. The connectors 40 are typically used to connect the cord 30 to the base 20 at spaced locations along the cord, such that the portions of the cord 30 between the connectors 40 are not attached to the base 20 and thus form the loops 32 around the periphery of the base 20.

In some embodiments, and referring still to FIGS. 1 and 2, the sandal 10 can further include one or more cord segments 70 and 79 that are positioned in an interior portion 74 of the base 20 such that they extend in a direction transverse to the longitudinal direction of the base 20. Each of these cord segments 70 and 79 are also connected to the base 20 by connectors 40 at either end to form loops 76 and 78 in the interior portion 74 of the base 20. In some embodiments, one cord segment 70 is positioned in the toe end 28 of the base 20 such that loop 76 forms a thong loop formed in the toe end 28 of the base 20 and, more specifically, in the portion of the toe end 28 of the base 20 that would be adjacent to the space between the big toe and the index toe of a wearer when they are wearing the exemplary sandal 10. In some embodiments, one or more cord segments 79 are positioned in an instep portion 75 of the base 20 such that one or more loops 78 are formed in the instep or central channel portion 75 of the base. Typically, each instep loop 78 is spaced at a predetermined distance (e.g., 1 inch) from each adjacent instep loop 78 to provide for adequate space between portions of a strap 50 (see FIG. 4) when the strap 50 is secured to the base 20 by using the instep loops 78, as described below.

Figure 3:
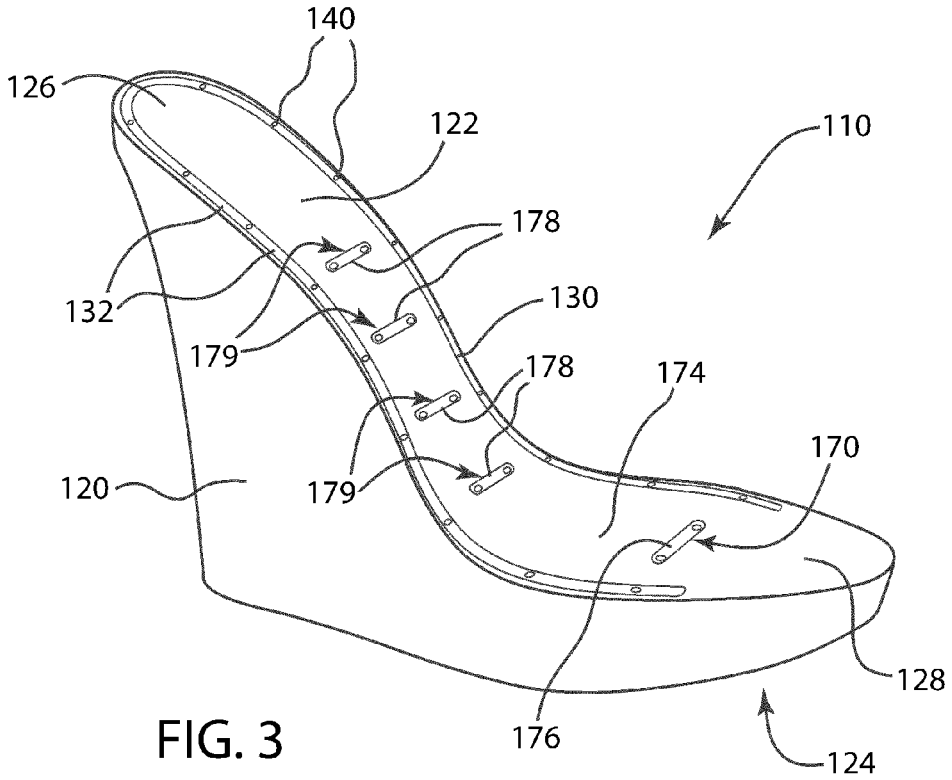
FIG. 3 is a perspective view of another exemplary sandal made in accordance with the present invention, but without a strap connected to the loops of the sandal.

With further regard to the base 20, the base 20 can be a substantially flat base 20, as shown in FIGS. 1 and 2. However, the base 20 can also be manufactured in various other shapes to thereby provide bases of various footwear styles. For example, and referring now to FIG. 3, the base 120 of an exemplary sandal 110 can, in some embodiments, be a wedge-shaped base 120. Similar to the sandal shown in FIGS. 1 and 2, the sandal 110 includes: a base 120 having an upper surface 122 and a lower surface 124 and extending from a rear heel end 126 to a forward toe end 128; a continuous cord 130 extending along the periphery of the upper surface 122 of the base 120 from a point near the toe end 128 on one side of the base 120, around the heel end 126, and continuing to a point near the toe end 128 on the opposite side of the base 120; and connectors 140 connecting the cord 130 to the base at spaced locations along the cord 130 such that the cord portions between the connectors form loops 132 around the periphery of the base 120. Furthermore, the sandal 110 also includes one or more cord segments 170, 179 that are positioned in an interior portion 174 of the base 120 with connectors 140 such that they extend in a direction transverse to the longitudinal direction of the base 120 and form loops 176, 179 such as a thong loop 176 or instep loops 178, in the interior portion 174 of the base 120. However, unlike the base 20 of the sandal 10 shown in FIGS. 1 and 2, the height of the base 120 at the rear heel end 126 of the base 120 of the sandal 110 is greater than the height of the base 120 at the forward toe end 128 of the sandal 110, as shown in FIG. 3. Of course, to the extent that it may be desired, bases of various other shapes can also be produced, including bases with other shapes of heels and the like, without departing from the spirit and scope of the subject matter disclosed herein.

As noted above, and referring now to FIGS. 4 and 5, the sandal 10 further includes a strap such as strap 50 in FIG. 4 or strap 50*a* in FIG. 5, each of which is configured to connect to the various loops 32, 76 and/or 78, which are formed on the base 20, to thereby form the upper portion 60, 60*a*, respectively, of the sandal 10. The strap 50, 50*a* can be formed from a variety of materials such as cloth, plastic or the like, and can be configured to connect to the loops in various ways in order to form the upper portion 60, 60*a* of the sandal 10. For example, in some embodiments, and as shown in FIG. 4, the strap 50 is comprised of a continuous piece of lace or string that has opposed ends 82, 84 covered by plastic or other similar material such that the strap 50 is adapted to be easily threaded through the loops of the sandal 10.

Figure 5:
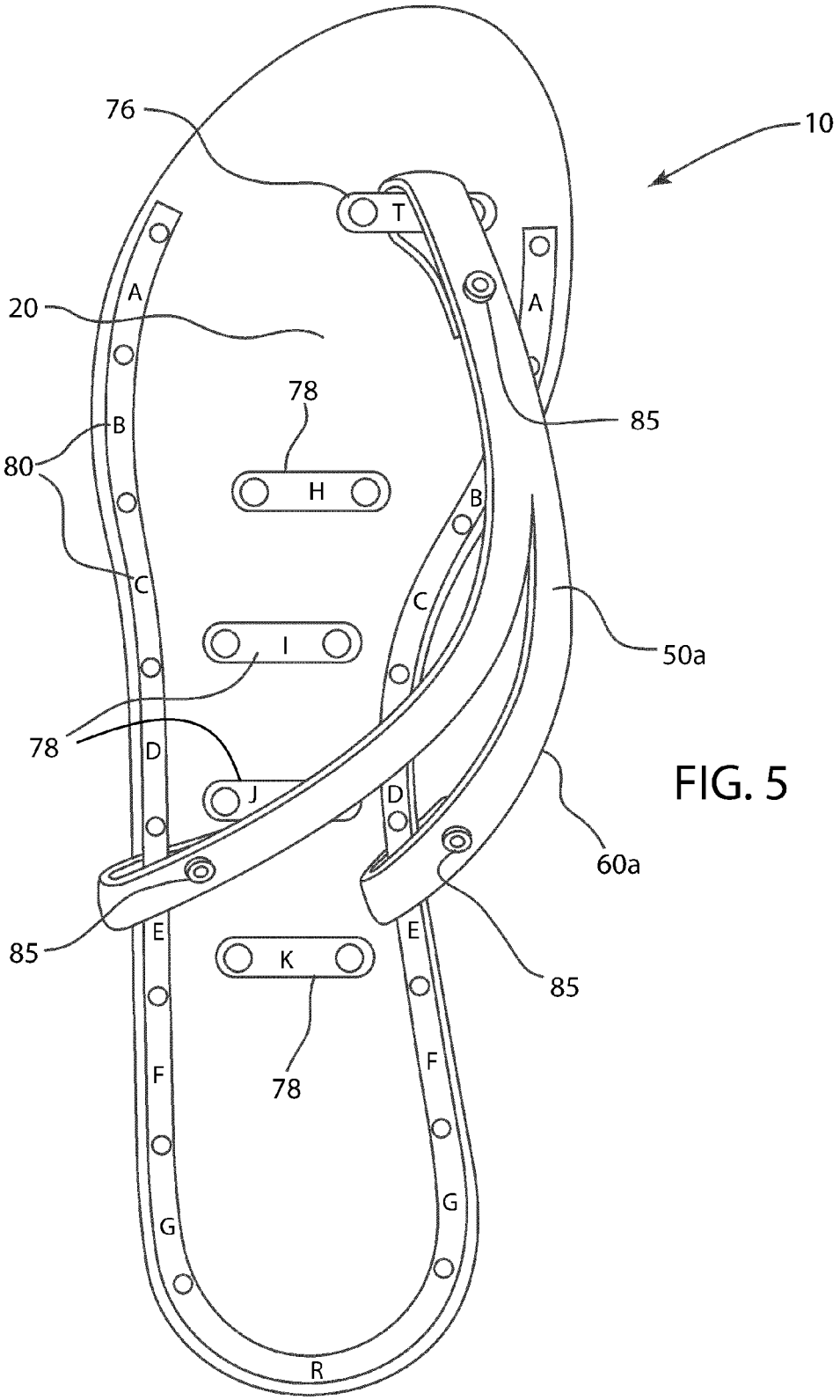
FIG. 5 is another top view of the exemplary sandal depicted in FIG. 1, but further illustrating a strap secured to the loops of the base by a snap.

In other embodiments, the strap can be preformed such that the strap is provided in a predetermined shape or style. In this regard, the preformed straps can be provided in many different preformed shapes and styles. One characteristic of the performed straps, however, is that an attachment means, such as a snap, buckle, or the like, is typically included on the preformed straps to allow the preformed strap to be readily secured around a particular loop 32, 76 and/or 78 of the sandal 10. For example, as shown in FIG. 5, the strap 50*a* can include snaps 85 at the ends of the strap 50*a* such that an end of the strap 50*a* can be threaded through a loop 32, 76, and then mated to itself by using the snap 85. Again, it is contemplated that numerous types of straps and numerous types of attachments can be used in accordance with the present invention and can easily be adapted for use as an upper portion of a sandal without departing from the spirit and scope of the subject matter described herein.

Figure 6:
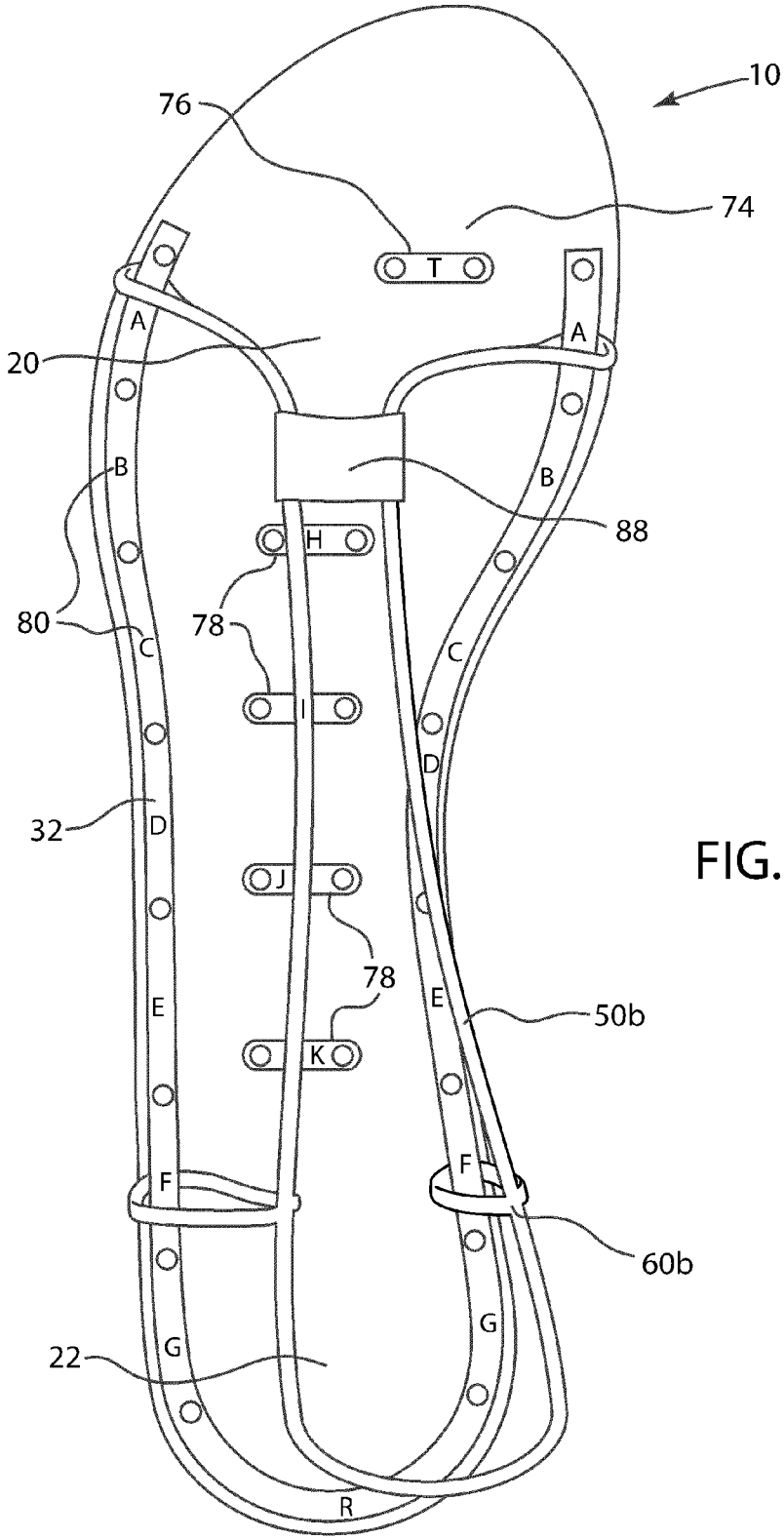
FIG. 6 is a perspective view of the exemplary sandal depicted in FIG. 1, but further illustrating a strap connected to the loops of the base as well as a means for securing portions of the strap together.

As a refinement, and referring now to FIG. 6, a sandal 10 of the present invention can also include a means for securing portions of a strap 50*b*. For example, portions of the strap 50*b* can be held together by a clasp 88 that attaches to the strap 50*b* on each side of the sandal 10 and brings the portions of the strap together over the interior portion 74 of the upper surface 22 of the base 20 of the sandal 10.

Figure 4:
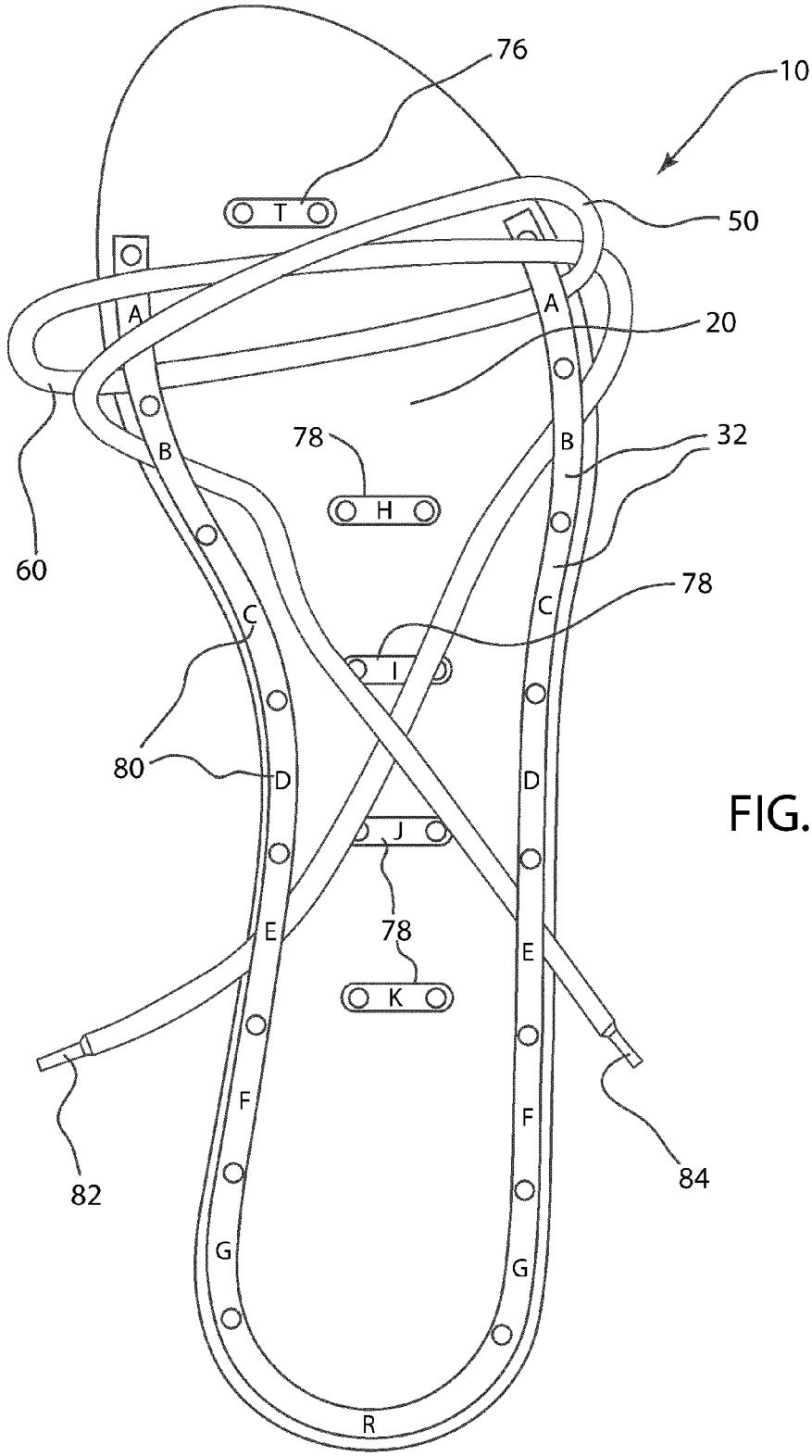
FIG. 4 is a top view of the exemplary sandal depicted in FIG. 1, but further illustrating a strap threaded through the loops of the base and forming the upper portion of the sandal.

Numerous types of other means for securing portions of the strap 50*b*, as well as the straps 50, 50*a* of FIGS. 4 and 5, together are also contemplated to be within the scope of the present invention including, for example, a single piece of leather that wraps around the portions of the strap 50, 50*a*, 50*b* and snaps closed. As would be recognized by those skilled in the art, such means for attaching portions of the strap 50, 50*a*, 50*b* together not only allow for various ornamental designs to be incorporated into the sandal 10, but they also provide a further means for securing the sandal 10 to the foot of a wearer as the means for attaching the portions of the strap 50, 50*a*, 50*b* together can be placed over the foot of the wearer when the sandal 10 is being worn.

Referring to FIGS. 4-6, the strap 50, 50*a*, 50*b* can be arranged in a variety of configurations such that the appearance of the upper portion 60, 60*a*, 60*b* of the sandal 10 can readily be changed without changing the base 20 of the sandal 10. For example, as shown in FIG. 4, in embodiments where the strap 50 is a continuous lace or string, the strap 50 can be threaded under loop "A" on either side of the sandal and then threaded over and under loop "B" on either side such that the strap 50 creates various patterns on top of the foot of a wearer and thereby produces a desired appearance when the sandal 10 is worn. Further, the strap 50 can also be placed through an instep loop 78 (e.g., "J") to hide a portion of the strap 50 under the foot of a wearer before it is secured to the wearer's foot (e.g., by tying or wrapping the strap around the foot of a wearer). As another example, and as shown in FIG. 5, in embodiments where ends of the preformed strap 50*a* include snaps 85 for securing the strap 50*a* to the base 20 of the sandal 10, the strap 50*a* can be snapped to the thong loop 76 ("T") of the sandal and to corresponding loops 32 ("E") on either side of the sandal 10 to provide a flip-flop-style of sandal.

In some embodiments, to facilitate the placement of the strap 50, 50*a*, 50*b* in various loops 32, 76, 78 of the sandal 10, each loop 32, 76, 78 of the sandal includes an identification means for identifying that loop. As shown in FIGS. 4-6, the identification means, in some embodiments, is comprised of a series of characters 80 of the alphabet that are printed or otherwise placed on each loop 32, 76, 78 of the sandal 10. To facilitate the placement of the strap 50, 50*a*, 50*b* in these loops 32, 76, 78, in some embodiments, the identification means for each loop 32 along one side of the base 20 corresponds to the identification means for each loop 32, along the opposite side of the base 20 such that a wearer can not only identify corresponding loops 32 on each side of the base 20 when connecting a strap 50, 50*a*, 50*b* to the base 20, but can also connect the strap 50, 50*a* to specific loops 32 on the base 20 to produce an upper portion 60, 60*a*, 60*b* of the sandal 10 with a particular configuration. In some embodiments, each loop 32 located on an inside edge of the base 20 of the sandal 10 is further labeled with the letter "i" (i.e., Ai-Gi), or another similar identification means, to indicate that each of those loops 32 is positioned on the inside edge of the base 20 of the sandal 10 (i.e., the side of the sandal that would be adjacent to the "big toe" of a wearer), and each loop 32 on the outside edge of the base 20 of the sandal 10 is further labeled with the letter "o" (i.e., Ao-Go), or another similar identification means, to indicate that each of those loops 32 are positioned on the outside edge of the base 20 of the sandal 10 (i.e., the side of the sandal that would be adjacent to the "pinky toe" of a wearer). In some embodiments, the loop 32 at the rear heel end 26 of the base 20 includes a separate identification means ("R") as compared to each loop 32 along the sides of the base 20 ("A" through "G"). Furthermore, in embodiments where one or more cord segments 70, 79 are positioned in and connected to an interior portion 74 of the base 20, the resultant loops 76, 78 in the interior portion 74 of the base 20 can also include separate identification means, such as an identification means for the thong loop 76 ("T") or an identification means for the instep loops 78 ("H" through "K").

Still further provided, in some embodiments of the present invention is a method of forming an upper portion of a sandal. In one exemplary implementation, a base having a plurality of loops extending around at least a portion of a periphery of an upper surface of the base is first provided. Then, a strap is threaded through the desired loops to form an upper portion of the sandal of a desired style or appearance. Once the strap had been threaded through the desired loops, the strap is then wrapped around and secured to the foot and/or ankle of the wearer to thereby complete the formation of the upper portion of the sandal. In some embodiments of the methods, the base of the sandal further includes one or more loops in the interior portion of the base such that the strap can also be threaded through the one or more loops in the interior portion of the base and then secured to the foot and/or ankle of the wearer to thereby form the upper portion of the sandal.

As one example of a method of forming an upper portion of a sandal, an upper portion of a sandal having an asymmetrical style can be formed by first providing a base of a sandal. To form the asymmetrically-styled upper portion, a strap in the form of a continuous lace is threaded through loop "A" on the left side of the base and pulled through loop "A" until the ends of the laces are even with one another. Then, the ends of the laces are separated and one end of the lace is threaded through loop "C" on the right side of the base, while the other end of the lace is pulled across the base and is threaded through loop "E" on the right side of the base. The end of the lace that was threaded through loop "C" on the right side of the base is then threaded through loop "E" on the left side of the base. At this point, the wearer then inserts a foot into the base such that portions of the lace extend across the upper portion of the foot of the wearer. 7E. The wearer then crosses the laces above the wearer's heel, and wraps the lace around the wearer's ankle prior to tying the two ends of the lace together to thereby secure the lace and the sandal to the wearer's foot. Subsequent to the tying the ends of the lace together, the lace ends can then be tucked under the portions of the lace that are wrapped around the wearer's ankle, to complete the formation of the upper portion of the asymmetrically-styled sandal.

As another example of a method of forming an upper portion of a sandal, an upper portion of a sandal having a thong style can be formed by also first providing a desired base of a sandal. To form the thong styled upper portion of the sandal, a strap in the form of a continuous lace is initially threaded through loop "T" until the ends of the lace are even. Then, a wearer places a foot on the base, with the lace positioned between the big toe and the next adjacent toe of the wearer's foot. The length of lace required to span the distance between loop "T" and the ankle of the wearer is then determined and, using that measurement, the lace is tied together adjacent to the ankle of the wearer. Once the laces are tied together adjacent to the wearer's ankle, the wearer then removes the foot from the base and the lace ends are separated and threaded through loop "D" or "E" on both sides of the base, depending on the location of the knot in the lace. The wearer then steps back onto the base, with the lace positioned between the wearer's big toe and next adjacent toe and with a portions of the lace extending around the wearer's foot. Similar to the asymmetrical style upper portion described above, the wearer then crosses the laces above the heel of the foot, and wraps the lace around the ankle prior to tying the two ends of the lace together to secure the lace and the sandal to the wearer's foot. Subsequent to tying the ends of the lace together, the lace ends can then be tucked under the portions of the lace wrapped around the wearer's ankle, to complete the formation of the thong style upper portion.

As yet another example of a method of forming an upper portion of a sandal, an upper portion of a sandal having a two strap style can be formed by again first providing a desired base of a sandal. To form the two strap upper portion of the sandal, a strap in the form of a continuous lace is initially threaded over and under loop "A" on the left and right side of the sandal. Then, the end of the lace that was threaded through loop "A" on the left side of the base if threaded through loop "C" on the right side of the base, and is then pulled back across the base such that it is threaded over and under loop "C" on the left side of the base. Both ends of the lace are then threaded through loops "J" and "K" in the interior portion of the base. Once both ends of the lace are threaded through loops "J" and "K," a wearer then steps into the sandal, such that two portions of the lace are positioned over the top of the wearer's foot, and separates the ends of the lace. The wearer then crosses the laces in front of the wearer's ankle, and wraps the lace around the ankle prior to tying the two ends of the lace together to secure the lace and the sandal to the wearer's foot. Again, subsequent to tying the ends of the lace together, the lace ends can then be tucked under the portions of the lace wrapped around the wearer's ankle, to complete the formation of the thong style upper portion.

As still another example of a method of forming an upper portion of a sandal, an upper portion of a sandal having a V strap (e.g., flip flop) style can be formed by again providing a desired base of a sandal. To form the V strap styled upper portion of the sandal, a strap in the form of a continuous lace is first threaded through loop "T" until the ends of the lace are even. Then, a knot is tied in the lace approximately 1 inch from where the lace meets loop "T." Once the knot is tied in the lace, the ends of the lace are then separated and the ends of the lace are individually threaded through loop "E" on either side of the base. A wearer then steps onto the base, with the lace positioned between the wearer's big toe and next adjacent toe and with the lace also positioned around either side of the wearer's foot. Similar to the styles of upper portions described above, the wearer then crosses the laces above the heel of the foot, and wraps the lace around the ankle prior to tying the two ends of the lace together to secure the lace and the sandal to the wearer's foot. Subsequent to tying the ends of the lace together, the lace ends are then tucked under the portions of the lace that are wrapped around the wearer's ankle, in order to complete the formation of the thong style upper portion.

As a further example of a method of forming an upper portion of a sandal, an upper portion of a sandal having a "criss cross" style can be formed by again first providing a desired base of a sandal. To form the two strap upper portion of the sandal, a strap in the form of a continuous lace is then initially threaded through loop "A" on the left and right side of the base. Then, the ends of the lace are pulled back across the base such that the laced is crossed. Both ends of the lace are then threaded over and back under loop "E" on the left side of the base and loop "E" on the right side of the base, prior to crossing the lace yet again and inserting the ends of the lace through loop "G" on the left and right side of the base. In this regard, the end of the lace that was threaded over and under loop "E" on the left side of the base is threaded through loop "G" on the right side of the base, and the end of the lace that was threaded over and under loop "E" on the right side of the base is threaded through loop "G" on the left side of the base. Once the ends of the lace are threaded through the loop "G" on either side of the sandal, a wearer then places a foot on the base such that the lace is in a criss cross pattern over the top of the wearer's foot. The wearer then crosses the laces above the wearer's heel and wraps the lace around the ankle, prior to tying the two ends of the lace together to secure the lace and the sandal to the wearer's foot. Again, subsequent to tying the ends of the lace together, the lace ends can then be tucked under the portions of the lace wrapped around the wearer's ankle, to complete the formation of the criss cross style upper portion.

The present invention thus advantageously provides sandals, and methods for forming an upper portion of sandals, wherein the straps of the sandals can be connected to and removed from loops on the base of the sandal in order to produce a number of desired styles for an upper portion of a sandal without changing the base of the sandal. By forming a number of loops along the base of the sandal, the straps can be positioned at various locations along a single sandal base and can be easily exchanged without changing the base of the sandal such that a wearer is able to construct a number of alternative sandal styles without having to purchase multiple pairs of sandals. Furthermore, although the majority of the features and refinements of the sandals disclosed herein have been described with reference to a sandal having a flat base, the various refinements and features of these embodiments are, of course, equally applicable to sandals having bases of varying shapes and sizes (e.g., a sandal with a wedge-shaped base such as that shown in FIG. 3) such that those features and refinements can be used to construct even further alternative sandal styles.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A sandal, comprising:

a base having an upper surface, a lower surface, sides extending completely around the sandal and meeting the upper surface along an edge which also extends completely around the sandal, the sandal extending in a longitudinal direction from a heel end to a toe end;

a continuous cord on the upper surface of the base, the cord being located adjacent said edge from a point near the toe end on one side of the base, along one side to the heel end around the heel end, and continuing along the other side to a point near the toe end on the opposite side of the base;

connectors connecting the cord to the upper surface of the base at spaced locations along the cord, such that cord portions between the connectors form loops near the edge of and on the upper surface of the base, which loops have opposed openings, both located on the upper surface of the base; and a strap that passes through a plurality of the loops, wherein the strap passes from one opposed opening to the other opposed opening, while lying on the upper surface of the base to form an upper portion of the sandal.

2. The sandal of claim 1, further comprising one or more segments of cord positioned in an interior portion of the upper surface of the base and extending in a direction transverse to the longitudinal direction of the base, each segment of cord being connected to the base by connectors such that the one or more segments of cord form loops in the interior portion of the base.

3. The sandal of claim 2, wherein one segment of cord is positioned in the toe end of the base such that a thong loop is formed in the toe end of the base.

4. The sandal of claim 2, wherein the one or more segments of cord are positioned in an instep portion of the upper surface of the base such that one or more instep loops are formed in the instep portion of the upper surface of the base and are spaced at a predetermined distance from each adjacent instep loop.

5. The sandal of claim 1, wherein each loop includes an identifier to identify that loop.

6. The sandal of claim 1, wherein the strap has opposed ends adapted to be threaded through the loops of the sandal.

7. The sandal of claim 1, wherein the strap includes an attachment to secure the strap to the loop of the sandal.

8. The sandal of claim 1, further comprising a securing structure to secure portions of the strap together.

* * * * *